US005867126A

United States Patent [19]

Kawahata et al.

[11] Patent Number: 5,867,126

[45] **Date of Patent: *Feb. 2, 1999**

[54] SURFACE-MOUNT-TYPE ANTENNA AND COMMUNICATION EQUIPMENT USING SAME

[75] Inventors: Kazunari Kawahata; Ken Okada, both of Kyoto, Japan

[73] Assignee: Murata Mfg. Co. Ltd, Kyoto, Japan

[ * ] Notice: The term of this patent shall not extend beyond the expiration date of Pat. No. 5,696,517.

[21] Appl. No.: 799,512

[22] Filed: Feb. 12, 1997

[30] Foreign Application Priority Data

Feb. 14, 1996 [JP] Japan ..... 8-026925

[51] Int. Cl.[6] ..... H01Q 1/24; H01Q 1/36

[52] U.S. Cl. ..... 343/702; 343/895; 343/700 MS

[58] Field of Search ..... 343/702, 895, 343/700 MS, 873, 846; H01Q 1/24, 1/38, 1/36

[56] References Cited

U.S. PATENT DOCUMENTS

| | | | |
|---|---|---|---|
| 4,151,532 | 4/1979 | Kaloi | 343/700 |
| 4,395,713 | 7/1983 | Nelson et al. | 343/713 |
| 5,696,517 | 12/1997 | Kawahata et al. | 343/702 |

FOREIGN PATENT DOCUMENTS

| | | |
|---|---|---|
| 474490 | 3/1992 | European Pat. Off. . |
| 526643 | 2/1993 | European Pat. Off. . |
| 623967 | 11/1994 | European Pat. Off. . |
| 746054 | 12/1996 | European Pat. Off. . |
| 19512003 | 10/1995 | Germany . |
| 2288284 | 10/1995 | United Kingdom . |
| 93 12559 | 6/1993 | WIPO . |

*Primary Examiner*—Hoanganh T. Le
*Attorney, Agent, or Firm*—Ostrolenk, Faber, Gerb & Soffen, LLP

[57] ABSTRACT

A current-inducing-type surface-mount-type antenna which is short in length and thin in thickness and which can be formed into a small size and communication equipment having the same mounted therein. A radiation electrode substantially in the shape of a letter L or a sideways U and a power supply electrode are formed on the surface of a base made of a dielectric or a magnetic substance with a gap therebetween. A short-circuit end of the radiation electrode and the power supply electrode are connected to a grounding terminal and a power supply terminal, respectively, which are formed on an end surface of the base.

12 Claims, 4 Drawing Sheets

SURFACE-MOUNT-TYPE ANTENNA AND COMMUNICATION EQUIPMENT USING SAME

BACKGROUND OF THE INVENTION

1. Field of the Invention

The present invention relates to a current-inducing-type surface-mount-type antenna for use in mobile communication equipment, such as portable telephones, and a radio LAN (Local Area Network), and communication equipment using the same.

2. Description of the Related Art

A conventional surface-mount-type antenna is shown in FIG. 8. A radiation electrode 72 and a power supply electrode 73 are formed on the surface of a base 71 of this surface-mount-type antenna 70 with a gap g therebetween. A grounding terminal 72*a* and a power supply electrode 73*a*, which are connected to one end of the radiation electrode 72 and to one end of the power supply electrode 73, are formed on one end surface 71*a* of the base 71. A capacity loaded electrode 74 is formed on the other end surface 71*b* of the base 71, which capacity loaded electrode 74 is connected to the other end of the radiation electrode 72.

In the conventional surface-mount-type antenna 70, the capacity loaded electrode 74 is provided for shortening the wavelength. However, the capacitance formed by this capacity loaded electrode 74 can be increased only by the specific inductive capacity er of the base 71 and the thickness of the base 71. Also, even if the radiation electrode 72 is formed into a meandering shape in order to increase the length of the radiation electrode 72 which resonates at a predetermined wavelength, there are limitations in terms of dimensions and shape, and the length of the base 71 cannot be made short. Therefore, it is difficult to achieve a small size with the conventional surface-mount-type antenna 70. Further, communication equipment having the conventional surface-mount-type antenna 70 incorporated therein has the drawback of the housing of the communication equipment being incapable of being formed to be small in size.

SUMMARY OF THE INVENTION

Accordingly, it is an object of the present invention to provide a surface-mount-type antenna which is short in length and thin in thickness and which can be formed into a small size, and communication equipment having the same mounted therein.

To achieve the above and other objects, according to one aspect of the present invention, there is provided a current-inducing-type surface-mount-type antenna, comprising a radiation electrode arranged substantially in the shape of a letter L or a sideways U, in which one end is open and the other end is short-circuited and a power supply electrode for exciting the radiation electrode, the radiation electrode and power supply electrode formed with a gap therebetween on one main surface of a base made of a dielectric or a magnetic substance, the radiation electrode and the power supply electrode being connected to a grounding terminal and a power supply terminal, respectively, formed on an end surface of the base.

According to another aspect of the present invention, there is provided a current-inducing-type surface-mount-type antenna, comprising a radiation electrode arranged substantially in the shape of a letter L or a sideways U, in which one end is open and the other end is short-circuited, the radiation electrode being formed extending over one main surface and at least one end surface of a base made of a dielectric or a magnetic substance, a power supply electrode formed on one main surface of the base with a gap being provided between the radiation electrode and the power supply electrode, the radiation electrode and the power supply electrode being connected to a grounding terminal and a power supply terminal, respectively, formed on another end surface of the base.

According to a further aspect of the present invention, there is provided communication equipment having the surface-mount-type antenna mounted therein In the present invention, as described above, since a radiation electrode substantially in the shape of a letter L or a sideways U is provided on at least one main surface from among the main surfaces and the end surfaces of a base, it is possible to increase the resonance wavelength with respect to the chip (base) size, and since a capacitance similar to a loading capacity is formed between the open end portion of the radiation electrode and the grounding electrode, it is possible to increase the resonance wavelength even further. This fact means that when the frequency is made fixed, it is possible to decrease the chip (base) size. Therefore, a small-sized surface-mount-type antenna can be realized, and thus communication equipment having the same mounted therein can be formed into a small size.

The above and further objects, aspects and novel features of the invention will become more apparent from the following detailed description when read in connection with the accompanying drawings.

DETAILED DESCRIPTION OF EMBODIMENTS OF THE INVENTION

Figure 1:
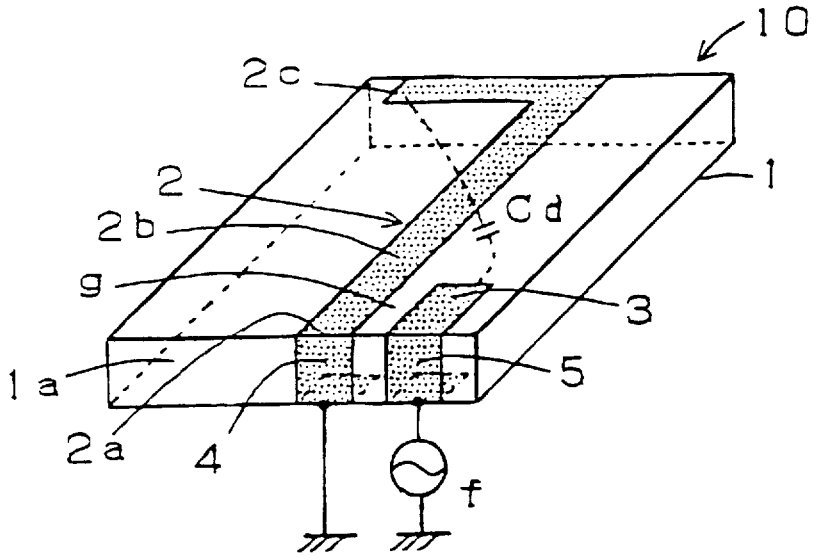
FIG. 1 is a perspective view of a first embodiment of a surface-mount-type antenna according to the present invention.

The preferred embodiments of the present invention will be described below with reference to the accompanying drawings. FIG. 1 shows a surface-mount-type antenna 10 according to a first embodiment of the present invention. A radiation electrode 2 in the shape of a letter L is formed on the surface of a rectangular base 1, made of a dielectric or a magnetic substance, of the surface-mount-type antenna 10. In the L-shaped radiation electrode 2, a short-circuit end 2*a* thereof is positioned on one short edge of the surface of the base 1, a main body 2*b* thereof extends straight to the other short edge opposite said one short edge and bends at right angles towards a long edge and extends in that direction, and an open end 2*c* is positioned at one corner of the surface of the base 1. The short-circuit end 2*a* of the radiation electrode 2 is connected to a grounding terminal 4 formed on one end surface of the base 1 and extends onto a rear surface thereof.

Further, a power supply electrode 3 is formed on the surface of the base 1 separated by a gap g from the short-circuit end portion 2*a* of the radiation electrode 2. This power supply electrode 3 is connected to a power supply terminal 5 which is formed on one end surface of the base 1 and extends to the rear surface thereof.

This power supply electrode 3 and the open end 2*c* of the radiation electrode 2 are equivalently spaced by a distance d and are electric-field-coupled with a capacitance Cd formed within this distance d. The power supply electrode 3 and the radiation electrode 2 are closest to each other at a gap g; however, since the short-circuit end portion 2*a* of the radiation electrode 2 is inductive, the degree of coupling is small. Meanwhile, even if the power supply electrode 3 and the open end 2*c* are apart from each other, since the surface-mount-type antenna 10 itself is small, the degree of coupling is large.

Figure 2:
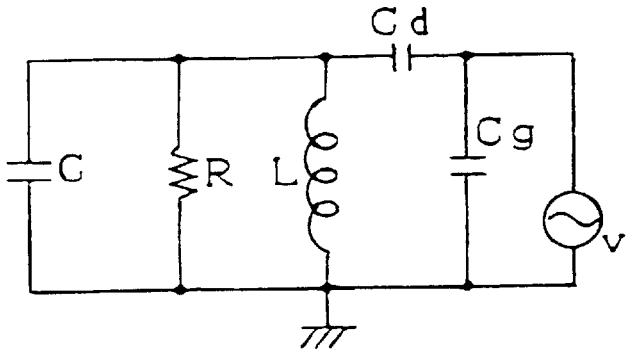
FIG. 2 is an equivalent electrical circuit diagram of the surface-mount-type antenna shown in FIG. 1.

An equivalent electrical circuit diagram of this embodiment is shown in FIG. 2. In FIG. 2, reference letter L denotes the radiation inductance of the radiation electrode 2. Reference letter R denotes radiation resistance. Reference letter Cd denotes capacitance which is formed mainly between the open end portion 2*c* of the radiation electrode 2 and the power supply electrode 3. Reference letter Cg denotes capacitance which is formed in the gap g. Reference letter C denotes capacitance between the radiation electrode and ground.

In this embodiment, since the radiation electrode 2 bends substantially in the shape of a letter L which increases its length, the radiation inductance L is increased. Therefore, as described above, a small chip (base) size can be achieved by itself, and the above-described capacitance Cd is increased by the capacitance loading effect of the open end portion 2*c*, thus achieving an-even smaller size.

Figure 3:
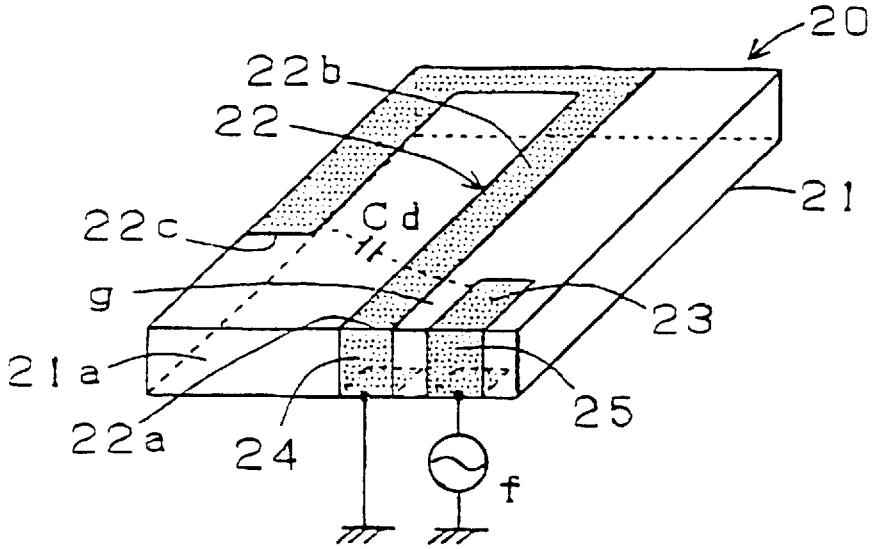
FIG. 3 is a perspective view of a second embodiment of a surface-mount-type antenna according to the present invention.

Next, a second embodiment of the present invention will be described below with reference to FIG. 3. A radiation electrode 22 substantially shaped like a sideways U and a power supply electrode 23 are formed on the surface of a rectangular base 21, made of a dielectric or a magnetic substance, of a surface-mount-type antenna 20 with a gap g therebetween. A short-circuit end 22*a* of the radiation electrode 22 is positioned on one short edge of the surface of the base 21, and a main body 22*b* thereof extends straight to the other short edge facing said one short edge and bends at right angles there, extending to one corner of a long edge along said other short edge and further bends at right angles there and extends along this long edge, and an open end 22*c* thereof is positioned approximately in the middle of this long edge. As a result, the radiation electrode 22 is formed substantially in the shape of a sideways U.

The short-circuit end 22*a* of the radiation electrode 22 and the power supply electrode 23 are respectively connected to a grounding terminal 24 and a power supply terminal 25 formed on one end surface of the base 21.

The power supply electrode 23 and the open end 22*c* of the radiation electrode 22 are equivalently spaced by a distance d in the same way as in the first embodiment and are electric-field-coupled with a capacitance Cd formed within this distance d. The power supply electrode 23 and the radiation electrode 22 are closest to each other at a gap g; however, since the short-circuit end portion 22*a* is inductive, the degree of coupling is small. Meanwhile, even if the power supply electrode 23 and the open end 22*c* are apart from each other, since the surface-mount-type antenna 10 itself is small, the degree of coupling is large.

This embodiment is structured as described above, and its equivalent electrical circuit diagram is similar to FIG. 2 which is referred to in the first embodiment.

In this embodiment, as compared with the radiation electrode 2 substantially shaped like a letter L shown in FIG. 1, there is provided the radiation electrode 22 substantially shaped like a sideways U, and the effective length of the radiation electrode 22 is longer and the loading capacity effect is large as the power supply electrode 23 and the open end 22*c* of the radiation electrode 22 are close to each other. Thus, an even smaller size can be achieved.

Figure 4:
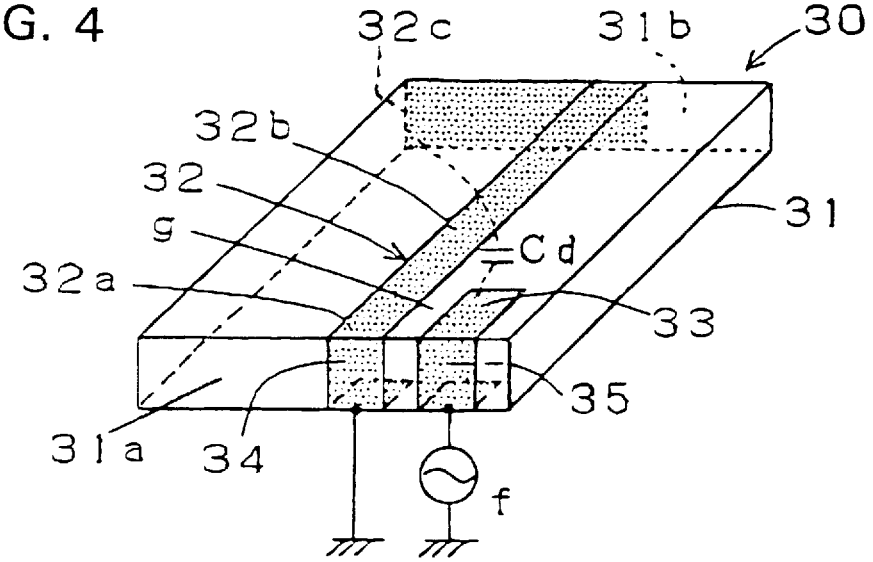
FIG. 4 is a perspective view of a third embodiment of a surface-mount-type antenna according to the present invention.

Next, a third embodiment of the present invention will be described below with reference to FIG. 4. A part of a radiation electrode 32 in the shape of a letter L and a power supply electrode 33 are formed on the surface of a rectangular base 31, made of a dielectric or a magnetic substance, of a surface-mount-type antenna 30 with a gap g therebetween. A short-circuit end 32*a* of the radiation electrode 32 is positioned on one edge side of the surface of the base 31. A main body 32*b* thereof extends straight to the other short edge facing said one short edge and bends from said other short edge to an adjacent end surface 31*b*, and extends in one direction on the adjacent end surface 31*b*. An open end 32*c* thereof is positioned at an edge of the adjacent end surface 31*b*. As a result, the radiation electrode 32 is formed substantially in the shape of a letter L extending over the surface and the end surface of the base 31.

The short-circuit end 32*a* of the radiation electrode 32 and the power supply electrode 33 are respectively connected to a grounding terminal 34 and a power supply terminal 35 formed on one end surface of the base 31.

The power supply electrode 33 and the open end 32*c* of the radiation electrode are equivalently spaced by a distance d in the same way as in the first embodiment and are electric-field-coupled with a capacitance Cd formed within this distance d.

This embodiment is structured as described above and is expressed by the equivalent electrical circuit diagram shown in FIG. 2. The same effects and advantages as those of the first embodiment described with reference to FIG. 1 can be realized. In particular, an even smaller size can be achieved due to a large capacitance loading effect.

Figure 5:
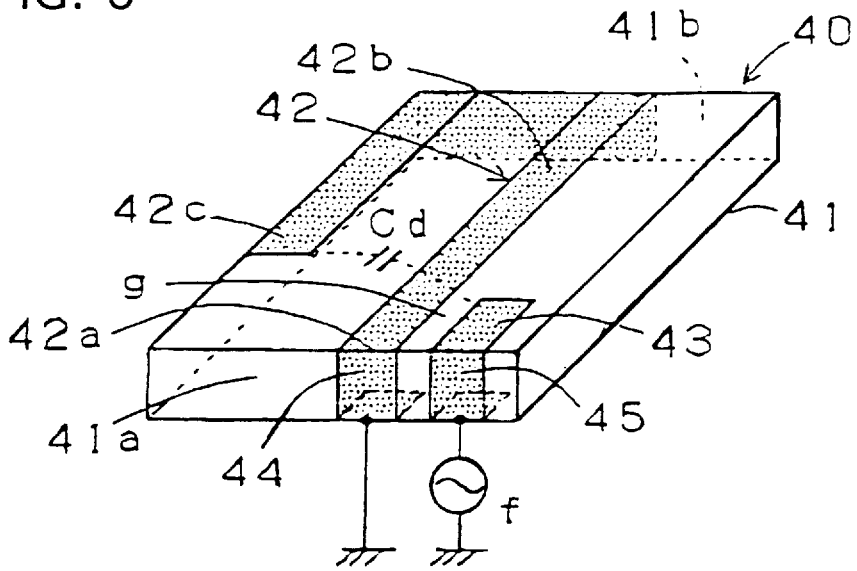
FIG. 5 is a perspective view of a fourth embodiment of a surface-mount-type antenna according to the present invention.

Next, a fourth embodiment of the present invention will be described below with reference to FIG. 5. A part of a radiation electrode 42 substantially in the shape of a sideways U and a power supply electrode 43 are formed on the surface of a rectangular base 41, made of a dielectric or a magnetic substance, of a surface-mount-type antenna 40 with a gap g therebetween. A short-circuit end 42*a* of the radiation electrode 42 is positioned on one short edge of the surface of the base 41, a main body 42*b* thereof extends straight to the other short edge facing said one short edge, bends from said other short edge to an end surface 41*b* adjacent thereto, extends in one direction on this adjacent end surface 41*b*, bends to the above-mentioned surface again at the end of the adjacent end surface 41*b*, and extends on this surface along a long edge thereof. An open end 42*c* thereof is positioned in the middle of this long edge. As a result, the radiation electrode 42 is formed substantially in the shape of a sideways U such that it extends from the surface of the base 41 along the end surface thereof and returns to the surface and extends in parallel.

A short-circuit end 42*a* of the radiation electrode 42 and the power supply electrode 43 are respectively connected to a grounding terminal 44 and a power supply terminal 45 formed on one end surface of the base 41.

The power supply electrode 43 and the open end 42*c* of the radiation electrode 42 are equivalently spaced by a distance d in the same way as in the first embodiment and are electric-field-coupled with a capacitance Cd formed within this distance d.

This embodiment is structured as described above and is expressed by the equivalent electrical circuit diagram shown in FIG. 2. The same effects and advantages as those of the second embodiment described with reference to FIG. 3 can be realized. In particular, the capacitance loading effect is large, and an even smaller size can be achieved.

Figure 6:
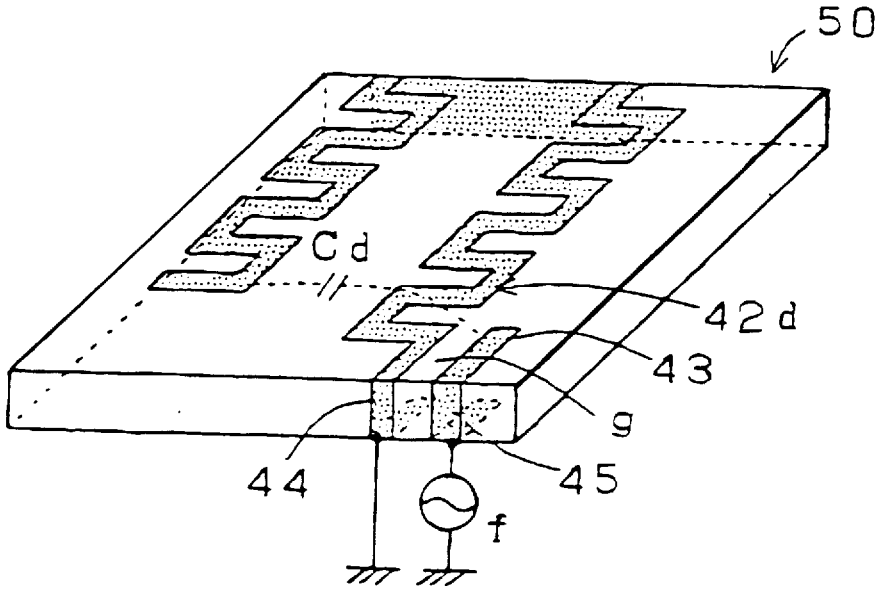
FIG. 6 is a perspective view of a fifth embodiment of a surface-mount-type antenna according to the present invention.

Next, a fifth embodiment of the present invention will be described below with reference to FIG. 6. In a surface-mount-type antenna 50 of this embodiment, there is provided a radiation electrode 42*d* formed by changing the shape of the base 41 of the radiation electrode 42 in the fourth embodiment shown in FIG. 5 from a line shape to a meandering shape.

This embodiment is expressed by the equivalent electrical circuit shown in FIG. 2, and the same effects and advantages as those of the fourth embodiment described with reference to FIG. 5 can be realized. Since, in particular, the radiation electrode 42*d* has a meandering shape, an even smaller size can be achieved.

Figure 7:
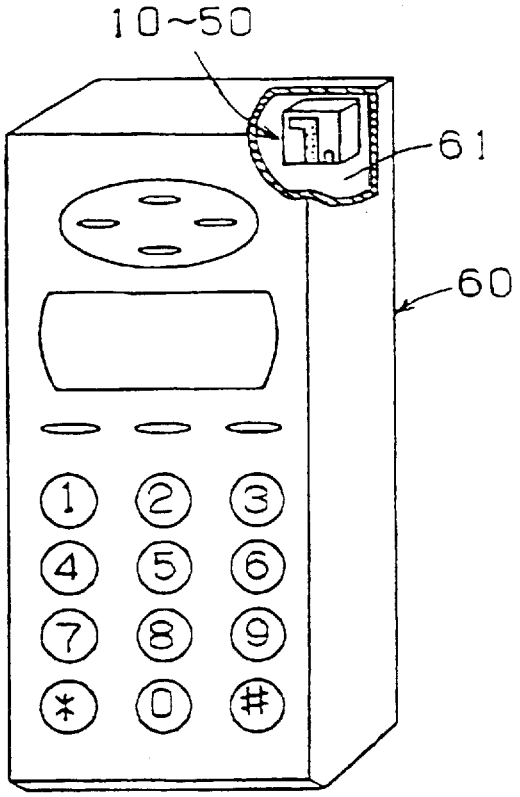
FIG. 7 is a perspective view of communication equipment having the surface-mount-type antenna mounted therein according to the present invention.
Figure 8:
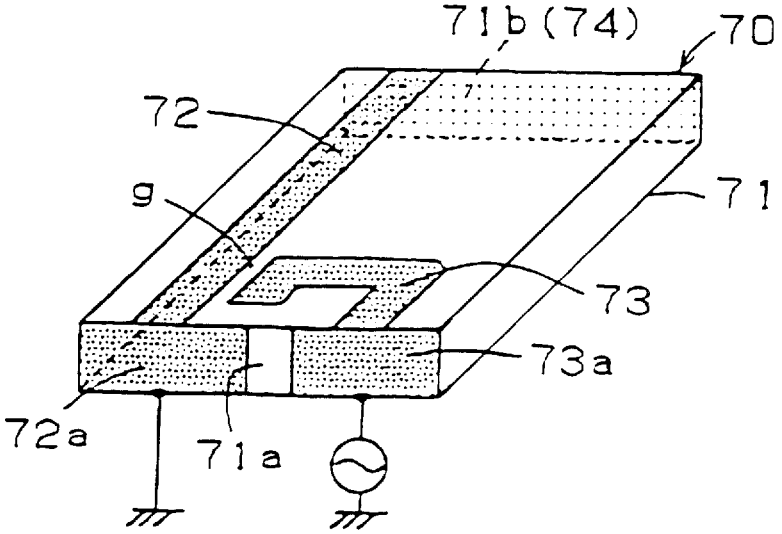
FIG. 8 PRIOR ART
FIG. 8 is a perspective view of a conventional surface-mount-type antenna.

Next, FIG. 7 shows a state in which the surface-mount-type antennas 10 to 50 of the above-described embodiments are mounted into communication equipment. The surface-mount-type antennas 10 to 50 are mounted by soldering grounding terminals and power supply terminals to predetermined terminals (not shown) on a set board (or a subboard thereof) 61 in communication equipment 60.

In the present invention, a radiation electrode in the shape of a letter L or a sideways U is provided on at least one main surface from among the main surfaces and end surfaces of a base, and a small thin base can respond to a long wavelength, i.e., a low frequency. Therefore, when the frequency is made fixed, it is possible to realize a small-sized current-inducing-type surface-mount-type antenna.

Since a surface-mount-type antenna can be made very small, the space occupied by communication equipment having a surface-mount-type antenna mounted therein is small, thus achieving a small size.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A current-inducing-type surface-mount-type antenna comprising a substantially U-shaped radiation electrode having a first open end and a second short-circuited end, the radiation electrode extending over one main surface and at least one end surface of a base comprising at least one of a dielectric material and a magnetic material, a power supply electrode disposed on one main surface of said base, a gap being provided between said power supply electrode and said radiation electrode, said radiation electrode and said power supply electrode being connected respectively to a grounding terminal and a power supply terminal disposed on another end surface of said base and wherein the U-shaped radiation electrode has the portion of the U-shape between the legs of the U-shape disposed on the end surface.

2. The current-inducing-type surface-mount-type antenna of claim 1, wherein the power supply electrode and the radiation electrode are disposed on said one main surface with the gap disposed therebetween.

3. The current-inducing-type surface-mount-type antenna of claim 1, wherein the radiation electrode has at least a portion of the U-shaped radiation electrode comprising a meandering shape.

4. The current-inducing-type surface-mount-type antenna of claim 1, wherein a capacitance is provided between the open end of the radiation electrode and the power supply electrode.

5. The current-inducing-type surface-mount-type antenna of claim 1, wherein both legs of the U-shaped radiation electrode are disposed on the main surface.

6. The current-inducing-type surface-mount-type antenna of claim 1, wherein both legs of the radiation electrode have a meandering shape.

7. Communication equipment comprising at least one of an electromagnetic frequency transmitter and an electromagnetic frequency receiver, an antenna connected to at least one of the transmitter and receiver, the antenna comprising a surface-mount-type antenna comprising a substantially U-shape radiation electrode having a first open end and a second short-circuited end, the radiation electrode extending over one main surface and at least one end surface of a base comprising at least one of a dielectric material and a magnetic material, a power supply electrode disposed on one main surface of said base, a gap being provided between said power supply electrode and said radiation electrode, said radiation electrode and said power supply electrode being connected respectively to a grounding terminal and a power supply terminal disposed on another end surface of said base and wherein the U-shape radiation electrode has the portion of the U-shape between the legs of the U-shape is disposed on the end surface.

8. The communication equipment of claim 7, wherein the power supply electrode and the radiation electrode are disposed on said one main surface with the gap disposed therebetween.

9. The communication equipment of claim 7, wherein the radiation electrode has at least a portion of the U-shaped electrode comprising a meandering shape.

10. The communication equipment of claim 7, wherein a capacitance is provided between the open end of the radiation electrode and the power supply electrode.

11. The communication equipment of claim 7, wherein both legs of the U-shaped radiation electrode are disposed on the main surface.

12. The communication equipment of claim 7, wherein both legs of the radiation electrode have a meandering shape.

* * * * *